United States Patent [19]

Tanaka

[11] Patent Number: 4,491,832

[45] Date of Patent: Jan. 1, 1985

[54] DEVICE FOR DISPLAYING CHARACTERS AND GRAPHS IN SUPERPOSED RELATION

[75] Inventor: Kazuyuki Tanaka, Kamakura, Japan

[73] Assignee: Matsushita Electric Industrial Co., Ltd., Osaka, Japan

[21] Appl. No.: 344,745

[22] Filed: Feb. 1, 1982

[30] Foreign Application Priority Data

Feb. 13, 1981 [JP] Japan ..... 56-20617

[51] Int. Cl.[3] ..... G09G 1/16

[52] U.S. Cl. ..... 340/721; 340/749; 340/747; 340/814; 340/735

[58] Field of Search ..... 340/731, 749, 745, 721, 340/747, 814, 750, 744, 728, 735, 790

[56] References Cited

U.S. PATENT DOCUMENTS

| | | | |
|---|---|---|---|
| 3,423,749 | 1/1969 | Newcomb | 340/731 |
| 3,686,662 | 8/1972 | Blixt et al. | 340/745 |
| 3,849,773 | 11/1974 | Katahira et al. | 340/745 |
| 3,999,168 | 12/1976 | Findley et al. | 340/731 |
| 4,090,188 | 5/1978 | Suga | 340/731 |
| 4,107,664 | 8/1978 | Marino | 340/731 |
| 4,163,229 | 7/1979 | Bodin et al. | 340/745 |
| 4,236,151 | 11/1980 | Russ et al. | 340/731 |
| 4,242,678 | 12/1980 | Somerville | 340/731 |
| 4,257,043 | 3/1981 | Tsuchiko | 340/721 |
| 4,283,724 | 8/1981 | Edwards | 340/731 |
| 4,317,114 | 2/1982 | Walker | 340/734 |
| 4,404,552 | 9/1983 | Hirahata et al. | 340/721 |

*Primary Examiner*—Marshall M. Curtis

*Attorney, Agent, or Firm*—Stevens, Davis, Miller & Mosher

[57] ABSTRACT

A display device for displaying characters and graphic patterns by using a raster scan type cathode ray tube is disclosed. Clock frequencies applied to a parallel-to-serial converter for converting parallel character data to serial data and a parallel-to-serial converter for converting parallel graphic data to serial data are different from each other so that the number of dots displayed on the cathode ray tube in one-character display period for the character data is different from that for the graphic data.

2 Claims, 12 Drawing Figures

DEVICE FOR DISPLAYING CHARACTERS AND GRAPHS IN SUPERPOSED RELATION

The present invention relates to a display device for displaying graphic patterns and characters by using a raster scan type cathode ray tube (CRT).

Figure 1:
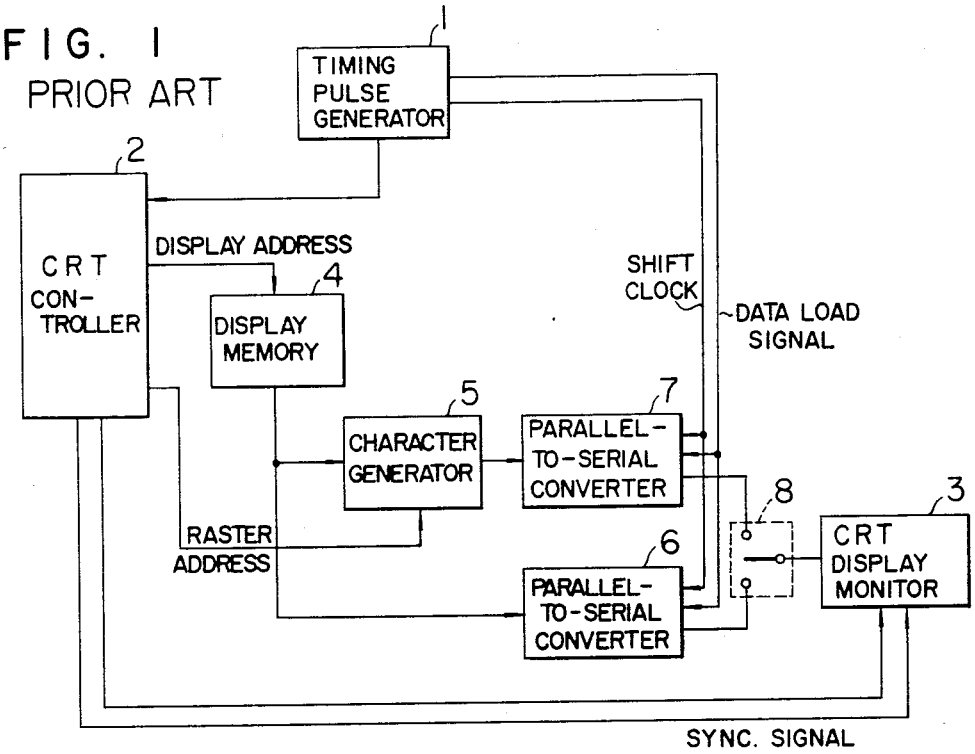
FIG. 1 PRIOR ART

A conventional display device for displaying the graphic patterns and the characters by using the raster scan CRT is constructed as shown in FIG. 1, in which numeral 1 denotes a timing pulse generator which generates timing signals for parallel-to-serial conversion and supplies signals synchronized with a one-character display period to a CRT controller 2. The CRT controller 2 scales down the signals synchronized with the one-character display period supplied from the timing pulse generator 1 and generates horizontal and vertical synchronizing signals to be supplied to a CRT display monitor 3, display addresses one for each of display positions on the CRT and raster addresses which define raster sequence of characters to be displayed on the CRT, the display addresses being supplied to a display memory 4 and the raster address being supplied to a character generator 5. The display memory 4 stores display data representative of the characters or the graphic patterns to be displayed on the CRT display monitor 3 and supplies the display data corresponding to the display addresses supplied from the CRT controller 2 to the character generator 5 and a first parallel-to-serial converter 6. The character generator 5 supplies the character bit train corresponding to the display data supplied from the display memory 4 to a second parallel-to-serial converter 7 in accordance with the sequence of the raster addresses supplied from the CRT controller 2.

The second parallel-to-serial converter 7 reads in the data of the character bit train supplied from the character generator 5 at a parallel data read-in timing generated by the timing pulse generator 1 and converts it to serial data at a timing of a shift clock. The first parallel-to-serial converter 6 reads in the display data supplied from the display memory 4 at a parallel data read-in timing generated by the timing pulse generator 1 and converts it to serial data at the timing of shift clock. Numeral 8 denotes a selector switch which selects the serial data supplied from the first and second parallel-to-serial converters 6 and 7 and supplies the selected data to the CRT display monitor 3 as a video signal.

The operation is now explained.

The CRT controller 2 scales down the signals synchronized with the one-character display period supplied from the timing pulse generator 1 and supplies the display addresses and the synchronizing signals to the display memory 4 and the CRT display monitor 3, respectively. The display memory 4 supplies the display data selected by the applied display addresses to the character generator 5 and the first parallel-to-serial converter 6. The character generator 5 supplies the applied display data to the second parallel-to-serial converter 7 as the character bit train in accordance with the sequence of the raster addresses supplied from the CRT controller 2. The first and second parallel-to-serial converters 6 and 7 read in the applied parallel data at the parallel read-in timing generated by the timing pulse generator 1 and convert them to the serial data at the timing of the shift clock. The serial data supplied from the first and second parallel-to-serial converters 6 and 7 are selected by the selector switch 8 and the selected data is supplied to the CRT display monitor 3 as the video signal.

In this manner, the characters or the graphic patterns are displayed on the CRT display monitor 3. By switching the selector switch 8 at an interval of one character display period, the characters and the graphic patterns can be simultaneously displayed on the screen.

The number of display dots in one character display period of the character displayed on the CRT display monitor 3 may be 9, 8, 7 and so on. In graphic processing for plots or lines, a CPU (not shown) calculates dot addresses for the graphic display and reads and writes the display memory 4. In this address calculation, the number of bits of the display memory is advantageously in byte unit. For example, in calculating the dot address for the graphic display, assuming that the number of characters in a line is 80 and the number of dots of the graphic pattern in one character display period is 8 and the display addresses are sequential, the address is expressed by;

$$\text{ADDRESS} \times (80 \times Y + X/8) \quad (1)$$

where X and Y are X-coordinate and Y-coordinate on the screen. The second term X/8 in the formula (1) can be obtained by shifting the X to the right by three bit positions.

On the other hand, if the number of dots of the graphic pattern in one-character display period is 9, the formula (1) is expersed as:

$$\text{ADDRESS} \times (80 \times Y + X/9) \quad (2)$$

In this case, the calculation of the second term X/9 is complex and hence a high speed graphic processing is difficult to attain. As a result, it is advantageous that the number of dots of the graphic pattern in one-character display period is $2^n$ (where n is an integer). Particularly, a multiple of a byte such as 8 bits or 16 bits is advantageous for processing. On the other hand, nine dots in one-character display period have been used in displaying characters in the existing machines from the standpoints of clear layout and case of watching.

As described above, since the desirable number of dots in one-character display period for the characters and that for the graphic patterns are different, when the character and the graphic pattern are to be simultaneously or alternately displayed in one-character display period, either one of the character display or the graphic display has to be sacrificed.

It is an object of the present invention to provide a display device which allows the display of the graphic patterns and the characters with different numbers of dots in one character display period for the graphic patterns and the characters.

Figure 3:
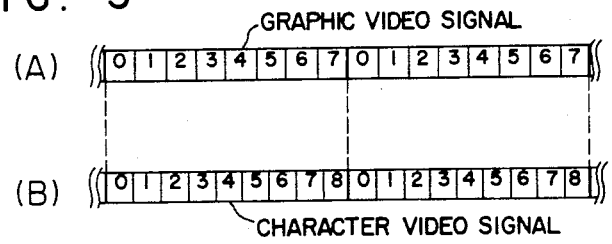
Figure 2:
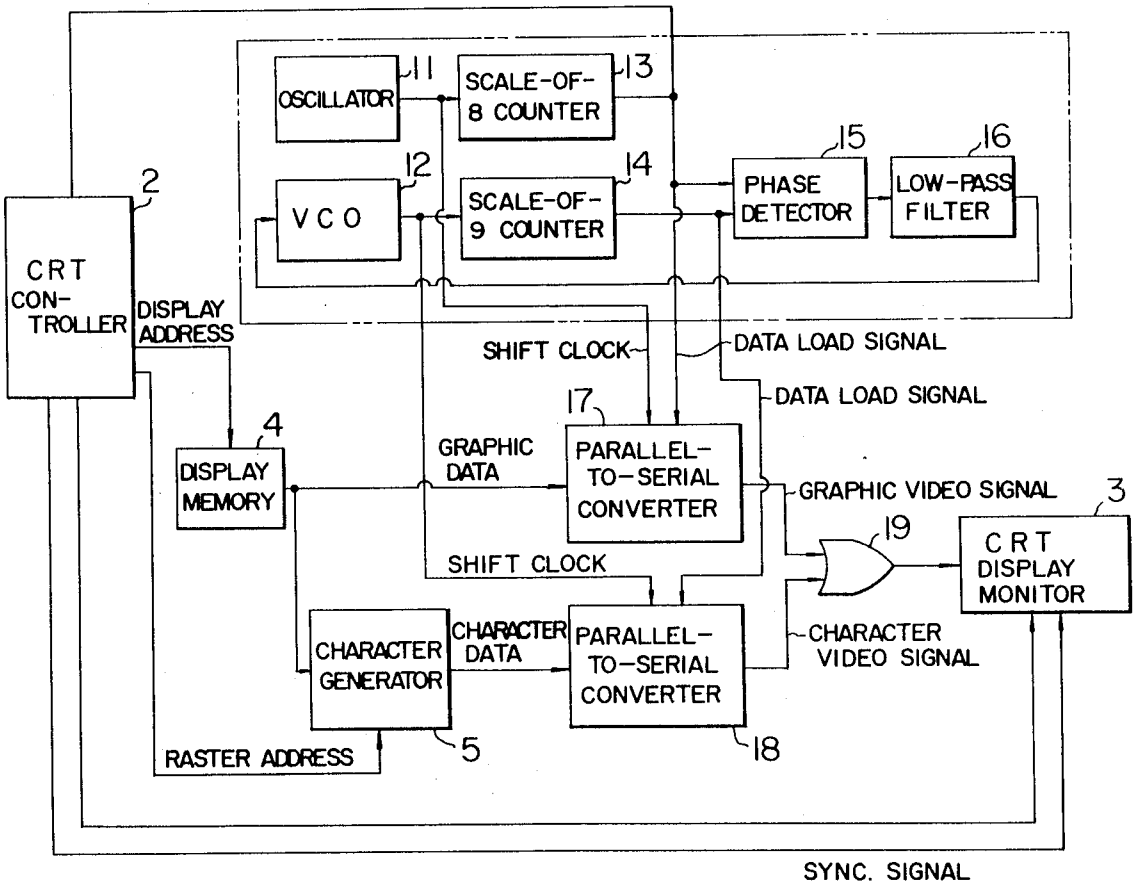
Figure 4A:
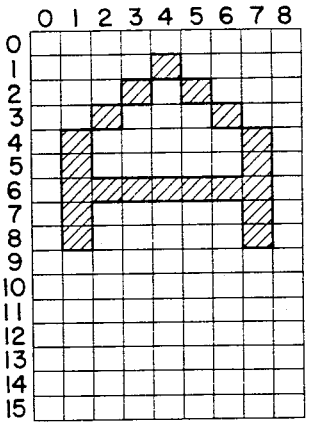
Figure 4B:
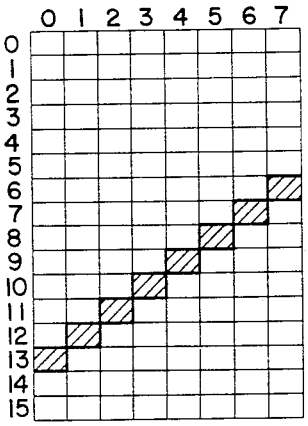
Figure 4C:
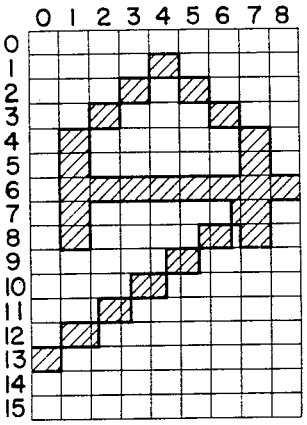
Figure 5A:
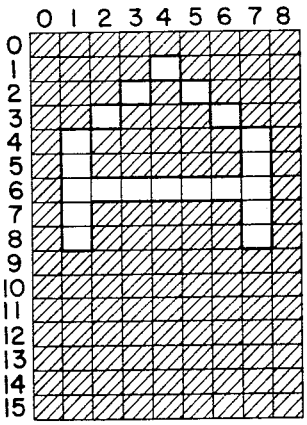
Figure 5B:
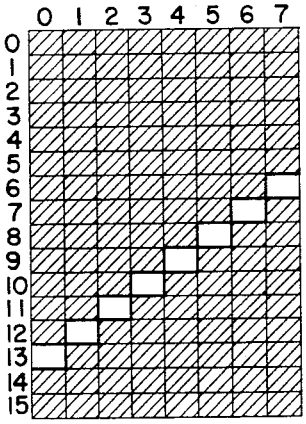
Figure 5C:
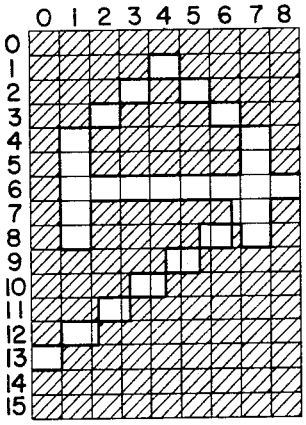
Figure 6A:
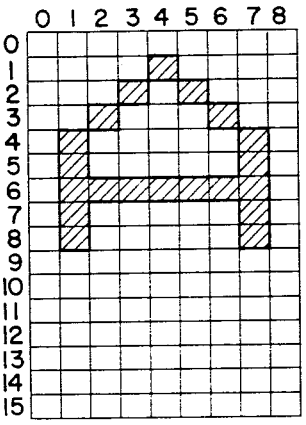
Figure 6B:
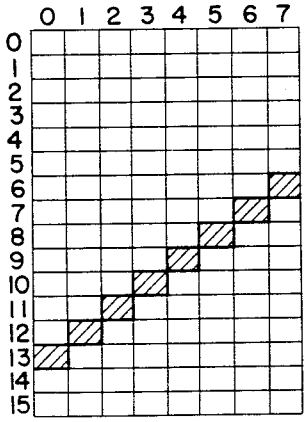
Figure 6C:
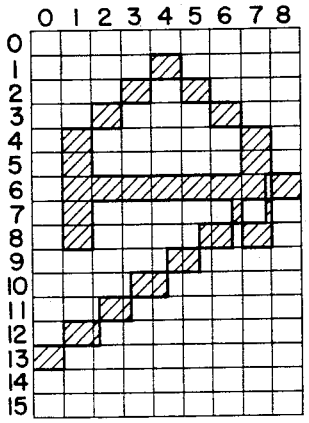

FIG. 1 show a block diagram of a conventional display device,

FIG. 2 shows a block diagram of a display device in accordance with one embodiment of the present invention, FIG. 3 shows output data of parallel-to-serial converters, FIGS. 4A–4C show display patterns by the circuit of FIG. 2, FIGS. 5A–5C show display patterns when an OR gate in FIG. 2 is replaced by an AND gate, and FIGS. 6A–6C show display patterns when the OR gate in FIG. 2 is replaced by an EOR gate.

The present invention intends to overcome the difficulties encountered in the conventional display device. One embodiment of the present invention is now explained.

Referring to FIG. 2, a CRT controller 2, a CRT display monitor 3, a display memory 4 and a character generator 5 function in the same manner as those shown in FIG. 1 and hence they are designated by the same numerals and not explained here. Numeral 14 denotes an oscillator having an oscillation frequency of 14–24 MHZ, numeral 12 denotes a voltage controlled oscillator (VCO), numeral 13 denotes a scale-of-eight counter ($\frac{1}{8}$ counter) which receives the output of the oscillator 11 as an input thereto, numeral 14 denotes a scale-of-nine counter (1/9 counter) which receives the output of the VCO 12 as an input thereto, numeral 15 denotes a phase detector which receives the outputs of the counters 13 and 14, and numeral 16 denotes a low-pass filter the output of which is supplied to the VCO 12 as a control voltage. The oscillator 11, VCO 12, counters 13 and 14, phase detector 15 and low-pass filter 16 form the timing pulse generator of FIG. 1. Numeral 17 denotes a parallel-to-serial converter which parallel-to-serial converts the graphic data and it corresponds to the parallel-to-serial converter 6 of FIG. 1. Numeral 18 denotes a parallel-to-serial converter which parallel-to-serial converts the character data and it corresponds to the parallel-to-serial converter 7 of FIG. 1. Numeral 19 denotes an OR gate which receives the outputs of the parallel-to-serial converters 17 and 18 and has its output terminal connected to the CRT display monitor 3.

The operation is now explained. The basic operation for displaying the character data and the graphic data on the CRT display monitor 3 is same as that in FIG. 1 and hence it is not explained here. The clock generated by the oscillator 11 is scaled down by a factor of eight in the counter 13 to produce the parallel data read-in (data load) signal for the parallel-to-serial converter 17 and the output of the counter 13 is supplied to one of phase compare input terminals of the phase detector 15.

On the other hand, the output of the VCO 12 is scaled down by a factor of nine in the counter 14 to produce a data load signal for the parallel-to-serial converter 18 and the output of the counter 14 is supplied to the other phase compare input terminal of the phase detector 15. The phase detector 15 compares the phases of the scaled-down outputs of the counters 13 and 14 to produce a signal proportional to the phase difference. A high frequency component of the output of the phase detector 15 is eliminated by the low-pass filter 16 and the output of the low-pass filter 16 is supplied to a frequency control input terminal of the VCO 12.

The parallel-to-serial converter 17 supplies the graphic data to one input of the OR gate 19 as a serial data in synchronism with the output of the counter 13 and the output of the counter 11. The parallel-to-serial converter 18 supplies the character data to the other input of the OR gate 19 as a serial data in synchronism with the output of the counter 14 and the output of the VCO 12. The OR gate 19 OR's the outputs of the parallel-to-serial converters 17 and 18 to produce a video signal.

In the above operation, the serial data from the parallel-to-serial converter 17 is produced in 8 dots/block configuration as shown in (A) in FIG. 3. Similarly, the serial data from the parallel-to-serial converter 18 is produced in 9 dots/block configuration as shown in (B) in FIG. 3. The displayed patterns of those data on the screen are explained with reference to FIGS. 4A–4C. FIG. 4A shows a displayed pattern for the character data block. FIG. 4B shows a displayed pattern for the graphic data block. FIG. 4C shows a displayed pattern when FIGS. 4A and 4B are ORed. It corresponds to the output from the OR gate 19 of FIG. 2. As seen from FIG. 4C, the character and the graphic pattern having different number of dots along the horizontal direction can be displayed in one block. When the OR gate 19 is replaced by an AND gate, a reversed pattern of the character and the graphic pattern can be displayed as shown in FIGS. 5A–5C, and when the OR gate 19 is replaced by an EOR gate (exclusive OR), overlapped areas of the character and the graphic pattern can be erased.

In the arrangement shown in FIG. 2, by changing the factors of scale-down in the counters 13 and 14, the graphic pattern having any number of dots and the character having any number of dots can be simultaneously displayed in the same block. By providing a plurality of PLL circuits each comprising the VCO 12, counter 14, phase detector 15 and low-pass filter 16, a plurality of characters and graphic patterns having different numbers of dots can be displayed.

In FIG. 2, a plurality of parallel-to-serial converters 17 and 18 may be provided, and the data applied to the parallel-to-serial converters may be either graphic or character. When the OR gate 19 of FIG. 2 is replaced by a switch and a combination of a NAND gate and NOR gate to combine the outputs of the parallel-to-serial converters, a plurality of characters and graphic patterns can be superimposed on the screen.

In the illustrated embodiment, the PLL circuit is used. Alternatively, the clock frequency to be supplied to the parallel-to-serial converters may be derived by frequency-dividing a frequency generated by a single oscillator by counters having desired scale-down factors and the counters are synchronized in each one-character display period.

As described hereinabove, according to the present invention, the number of display dots in one-character display period for the graphic data may be different from that for the character data and a plurality of characters and graphic patterns can be displayed in superposition on one screen.

What is claimed is:

1. A display device comprising:

display memories for storing character codes and graphic images corresponding to characters and graphs to be displayed in superposed relation on a screen of a raster-scan type cathode ray tube;

first and second parallel-to-serial converters for reading out plural-bit parallel graphic data and plural-bit parallel character data from said display memories in synchronism with a raster-scan timing of said tube in order to output graphic serial data and character serial data respectively;

logic means for logically combining the output graphic serial data and character serial data to produce a video signal to be applied to said cathode ray tube;

a fixed oscillator for generating and applying a first parallel-to-serial conversion control clock signal to said first parallel-to-serial converter;

a PLL circuit for generating and applying a second parallel-to-serial conversion control clock signal to said second parallel-to-serial converter;

means for generating first and second data load signals to cause respective data read-out operations of said first and second converters and for synchronizing said PLL circuit by comparing generated first and second data load signals to selectively produce any of a plurality of numbers of displayed character dots which may be different from a number of displayed graphic dots, whereby the character font of displayed characters can be freely changed irrespective to graphic dots.

2. A display device comprising:

display memories for storing character codes and graphic images corresponding to characters and graphs to be displayed in superposed relation on a screen of a raster-scan type cathode ray tube;

first and second parallel-to-serial converters for reading out plural-bit parallel graphic data and plural-bit parallel character data from said display memories in synchronism with a raster-scan timing of said tube in order to output graphic serial data and character serial data respectively;

logic means for logically combining the output graphic serial data and character serial data to produce a video signal to be applied to said cathode ray tube;

a PLL circuit for generating and applying a first parallel-to-serial conversion control clock signal to said first parallel-to-serial converter;

a fixed oscillator for generating and applying a second parallel-to-serial conversion control clock signal to said second parallel-to-serial converter;

means for generating first and second data load signals to cause respective data read-out operations of said first and second converters and for synchronizing said PLL circuit by comparing generated first and second data load signals to selectively produce any of a plurality of numbers of displayed graphic dots which may be different from a number of displayed character dots, whereby the graphic font of displayed graph images can be freely changed irrespective of character dots.

* * * * *